US006725741B2

(12) United States Patent
Menzies

(10) Patent No.: US 6,725,741 B2
(45) Date of Patent: Apr. 27, 2004

(54) COMPACT PEDAL ASSEMBLY WITH ELECTRICAL SENSOR ARM PIVOTAL ABOUT AXIS SPACED FROM PEDAL AXIS

(75) Inventor: Brad C. Menzies, Flint, MI (US)

(73) Assignee: Teleflex Incorporated, Plymouth Meeting, PA (US)

( * ) Notice: Subject to any disclaimer, the term of this patent is extended or adjusted under 35 U.S.C. 154(b) by 72 days.

(21) Appl. No.: 09/974,152

(22) Filed: Oct. 9, 2001

(65) Prior Publication Data

US 2003/0070503 A1 Apr. 17, 2003

(51) Int. Cl.[7] ..... G05G 1/14
(52) U.S. Cl. ..... 74/514
(58) Field of Search ..... 74/512, 513, 514, 74/560; 192/75, 76; 188/78, 325, 334, 342

(56) References Cited

U.S. PATENT DOCUMENTS

| | | | | | |
|---|---|---|---|---|---|
| 2,111,755 | A | * | 3/1938 | Compton | 188/106 A |
| 4,958,607 | A | | 9/1990 | Lundberg | 123/399 |
| RE34,302 | E | * | 7/1993 | Imoehl | 123/399 |
| 5,241,936 | A | * | 9/1993 | Byler et al. | 123/399 |
| 5,295,409 | A | * | 3/1994 | Byram et al. | 74/514 |
| RE34,574 | E | * | 4/1994 | Imoehl | 123/399 |
| 5,385,068 | A | * | 1/1995 | White et al. | 74/512 |
| 5,408,899 | A | | 4/1995 | Stewart | 74/513 |
| 5,529,296 | A | | 6/1996 | Kato et al. | 267/155 |
| 5,551,317 | A | | 9/1996 | Gautier et al. | 74/560 |
| 5,768,946 | A | * | 6/1998 | Fromer et al. | 74/514 |
| 5,865,067 | A | | 2/1999 | Knapp | 74/512 |
| 5,868,039 | A | | 2/1999 | Baumann | 74/512 |
| 5,868,040 | A | | 2/1999 | Papenhagen et al. | 74/513 |
| 5,934,152 | A | | 8/1999 | Aschoff et al. | 74/513 |
| 6,003,404 | A | | 12/1999 | Hannewald | 74/512 |
| 6,070,490 | A | | 6/2000 | Aschoff et al. | 74/513 |
| 6,147,590 | A | * | 11/2000 | Mikolcic | 338/153 |
| 6,164,155 | A | * | 12/2000 | Tonissen et al. | 74/514 |
| 6,220,222 | B1 | | 4/2001 | Kalsi | 123/399 |
| 6,330,838 | B1 | * | 12/2001 | Kalsi | 74/514 |
| 6,401,566 | B1 | * | 6/2002 | Beale et al. | 74/512 |
| 6,460,429 | B1 | * | 10/2002 | Staker | 74/513 |
| 6,470,768 | B2 | * | 10/2002 | Kato et al. | 74/513 |
| 6,474,191 | B1 | * | 11/2002 | Campbell | 74/514 |

FOREIGN PATENT DOCUMENTS

| | | |
|---|---|---|
| DE | 4407005 | 3/1995 |
| DE | 29611890 | 10/1996 |
| DE | 19521821 | 12/1996 |
| DE | 19612830 | 7/1997 |
| EP | 0818666 | 1/1998 |
| EP | 1055913 | 11/2000 |

* cited by examiner

*Primary Examiner*—Chong H. Kim
(74) *Attorney, Agent, or Firm*—Howard & Howard

(57) ABSTRACT

A brake cover (18) and shaft (24) rotate with a pedal lever (20) relative to a central section (14) of the housing (12) rotate a pedal gear (76). The pedal gear (76) rotates a sensor gear (74) to rotate a sensor arm (46) about a sensor axis (48). The sensor arm (46) supports sensor members (58) that move along sensor bands (50) to generate an electrical signal. As the brake cover (18) rotates with the pedal lever (20) it uncoils coil springs (84) to cause brake shoes (80) to pivot radially outward about respective posts (82) frictionally engage the interior surface (78) of the central section (14) to thereby provide a resistance or hysteresis to movement of the pedal lever (20). One feature resides in at least two elements (74, 76) to interconnect the sensor arm (46) and the pedal arm (20) to reduce space while maintaining the requisite movement of the sensor members (58) over the sensor bands (50) and the other feature resides in spacing the braking mechanism axially from the sensor arm (46) in radially overlapping relationship to one another along the pedal axis (A).

12 Claims, 6 Drawing Sheets

COMPACT PEDAL ASSEMBLY WITH ELECTRICAL SENSOR ARM PIVOTAL ABOUT AXIS SPACED FROM PEDAL AXIS

RELATED APPLICATION

This application discloses the same embodiment of a pedal assembly as co-pending Ser. No. 09/974,667 filed concurrently herewith but claims a different patentable feature of that embodiment.

BACKGROUND OF THE INVENTION

1. Field of the Invention

The subject invention relates to a pedal assembly with a sensor that generates an electric signal for controlling a vehicle system.

2. Description of the Prior Art

Pedal assemblies for controlling the throttle, clutch and braking systems in automotive vehicles have recently replaced mechanical linkage mechanisms with electrical sensors to generate electrical signals indicative of the degree of movement of the pedal to control the vehicle system. Besides cost and performance criteria, it is essential that the assembly occupy a minimum of space, as space within a vehicle is limited and is in demand for various uses.

In a recent assembly shown in U.S. Pat. No. 6,220,222 in the name of Kalsi and assigned to the assignee of the subject application, the pedal lever rotates a sensor arm that supports sensor members and circular sensor bands are supported by the housing to co-act with the sensor members to produce and electrical signal. The sensor arm extends radially from the pivot axis of the pedal and in order to obtain the desired sensitivity, the movement of the sensor members over the bands must be maximized or be at least a predetermined amount. As the sensor arm normally rotates about the pedal axis, the radial extent of the sensor arm must be sufficient to obtain a sufficiently long enough arc of sensor band to attain the requisite sensitivity. However, in some situations the demands for space are so critical that it is desirable to reduce the space between the axis of rotation of the pedal arm the sensor band or bands, whether the bands be straight or arcuate.

SUMMARY OF THE INVENTION AND ADVANTAGES

The subject assembly provides a compact pedal assembly for electronically controlling a vehicle. The assembly comprises a housing, a pedal lever supported by the housing for pivotal movement about a pedal axis, and a sensor arm movably supported by the housing. The housing supports at least one sensing band and at least one sensor member is supported by the sensor arm for movement with the sensor arm to co-act with the sensing band. The assembly is characterized by a mechanism of at least two elements movable relative to one another and interconnecting the pedal lever and the sensor arm for moving the sensor arm in response to movement of the pedal lever.

Accordingly, by interconnecting the pedal arm and the sensor arm with a mechanism instead of a direct connection, the operative space of the pedal lever and the sensor arm can be reduced to provide more compact packaging.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is a perspective view from the brake cover side and partially cut away and in cross section of the preferred embodiment; and.

DETAILED DESCRIPTION OF THE PREFERRED EMBODIMENT

Figure 1:
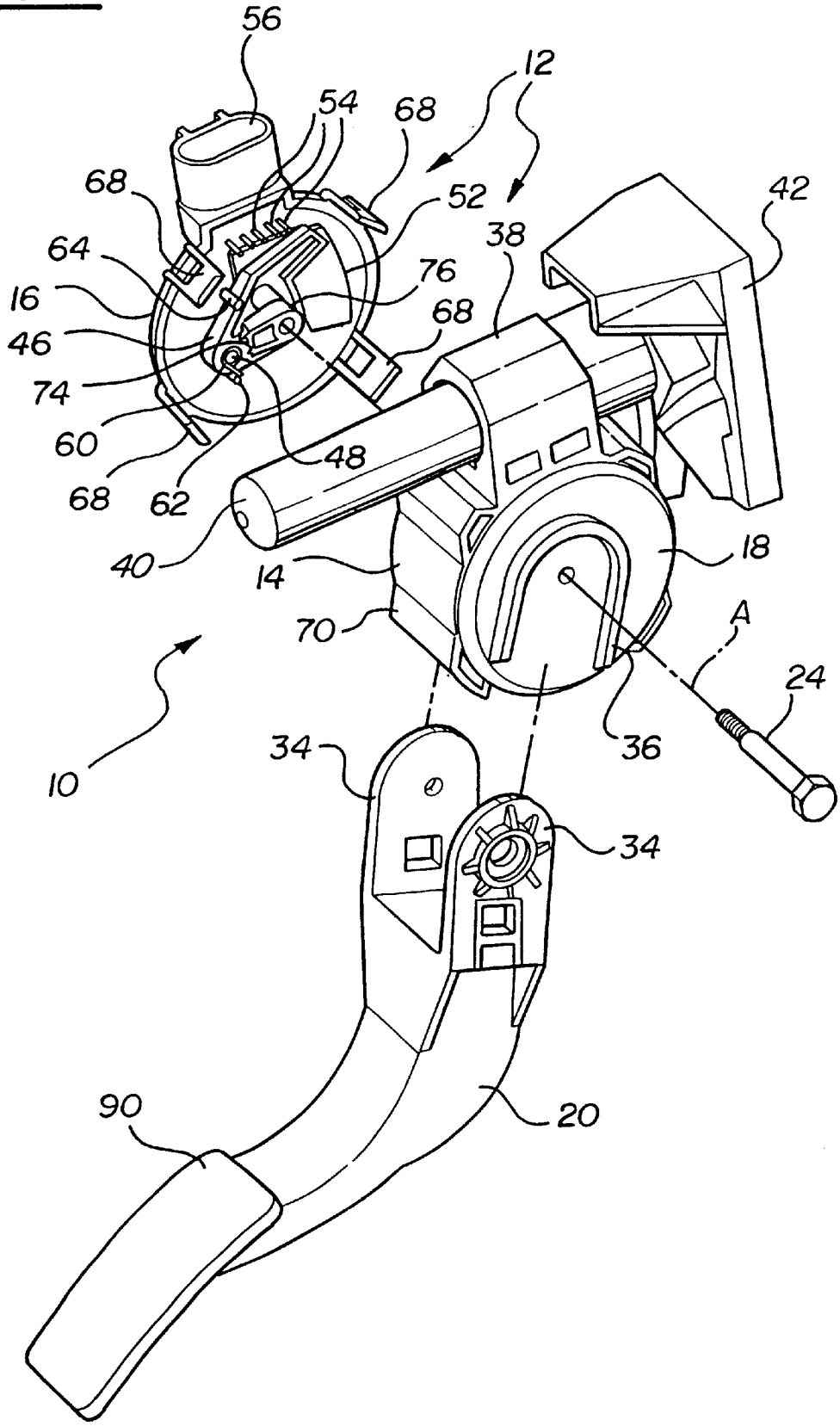
FIG. 1 is an exploded-perspective view from the brake cover side of the preferred embodiment.
Figure 2:
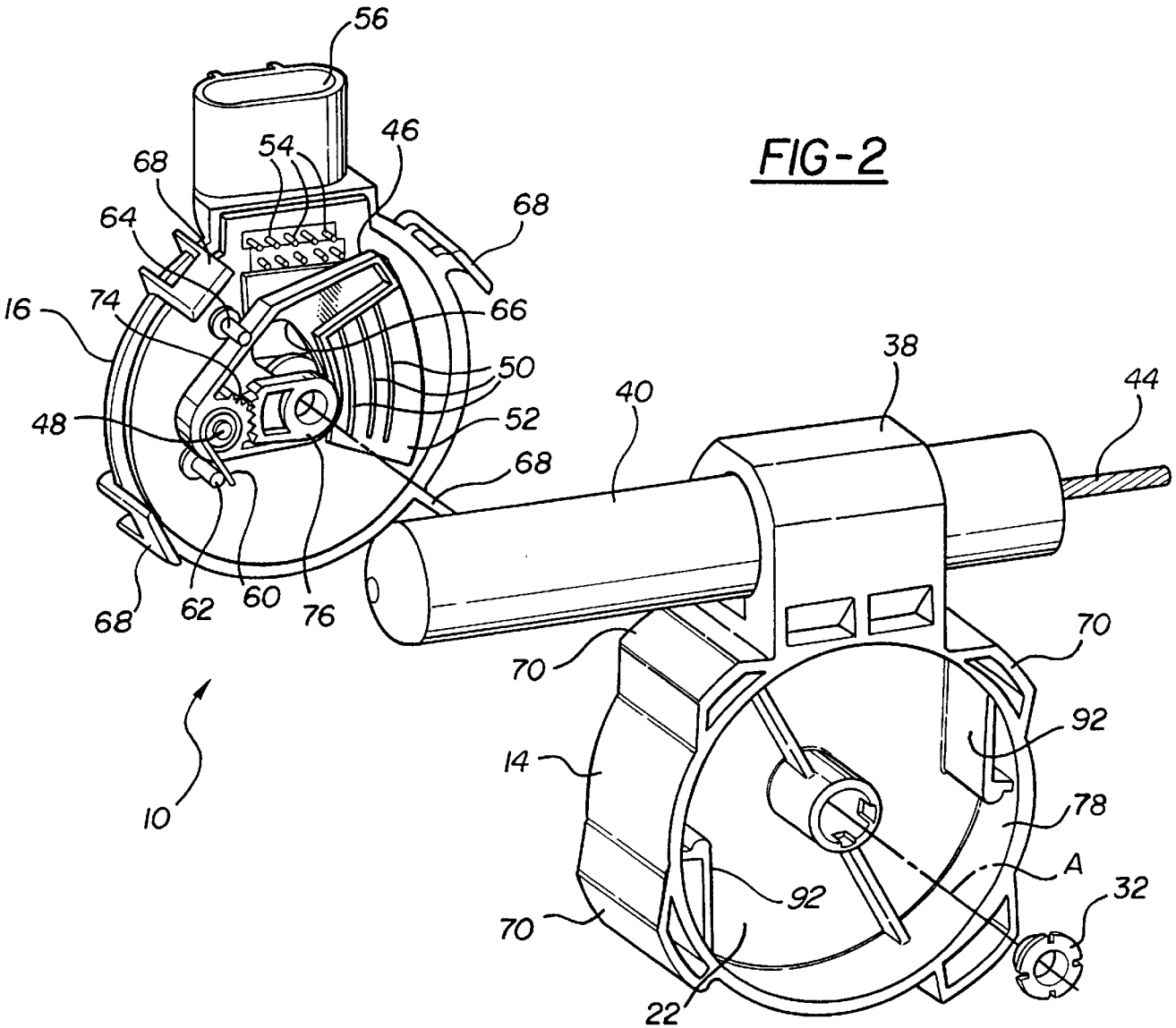
FIG. 2 is an exploded perspective view of the housing and the sensor cover of the preferred embodiment.
Figure 3:
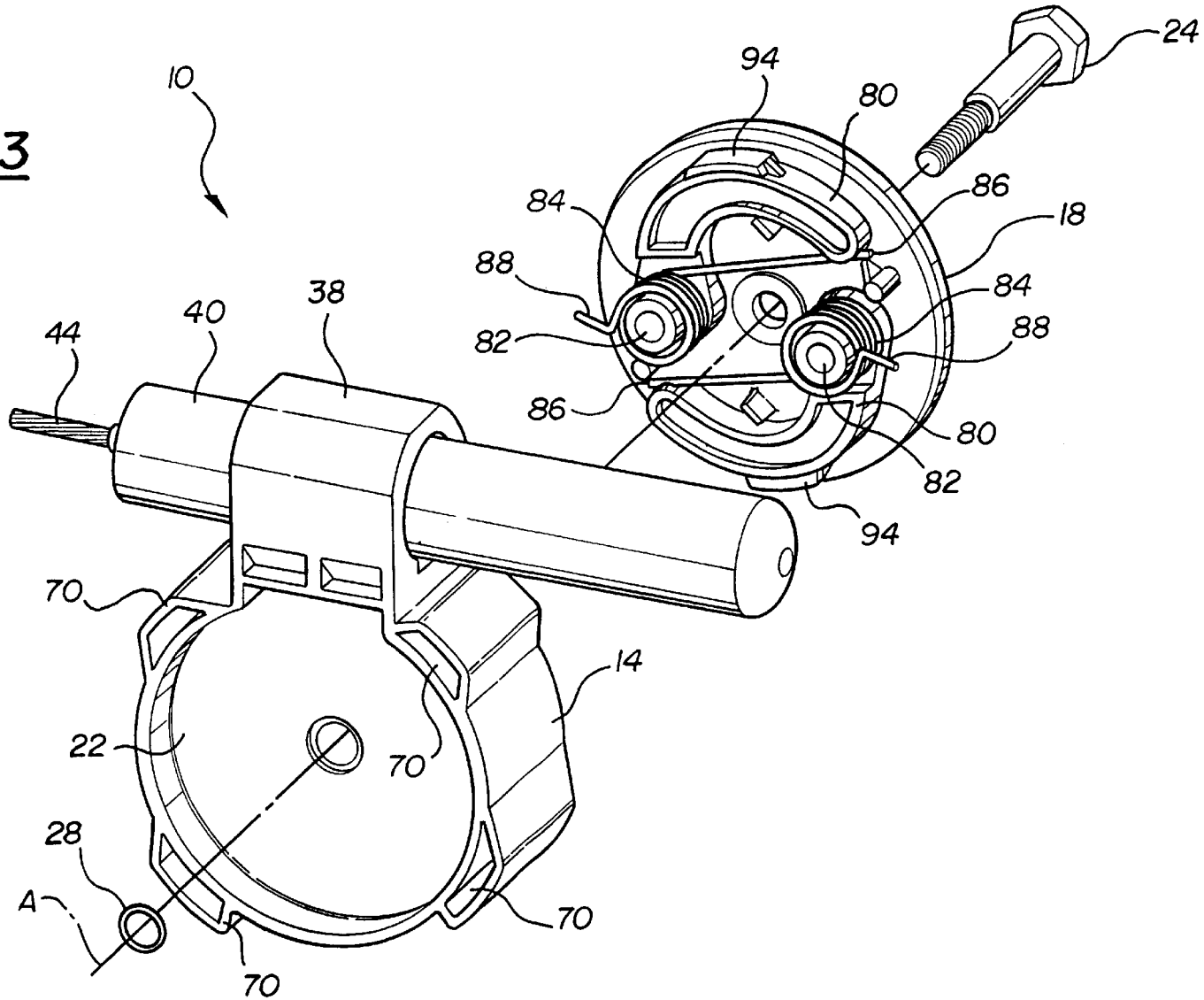
FIG. 3 is an exploded perspective view of the housing and the brake cover of the preferred embodiment.
Figure 4:
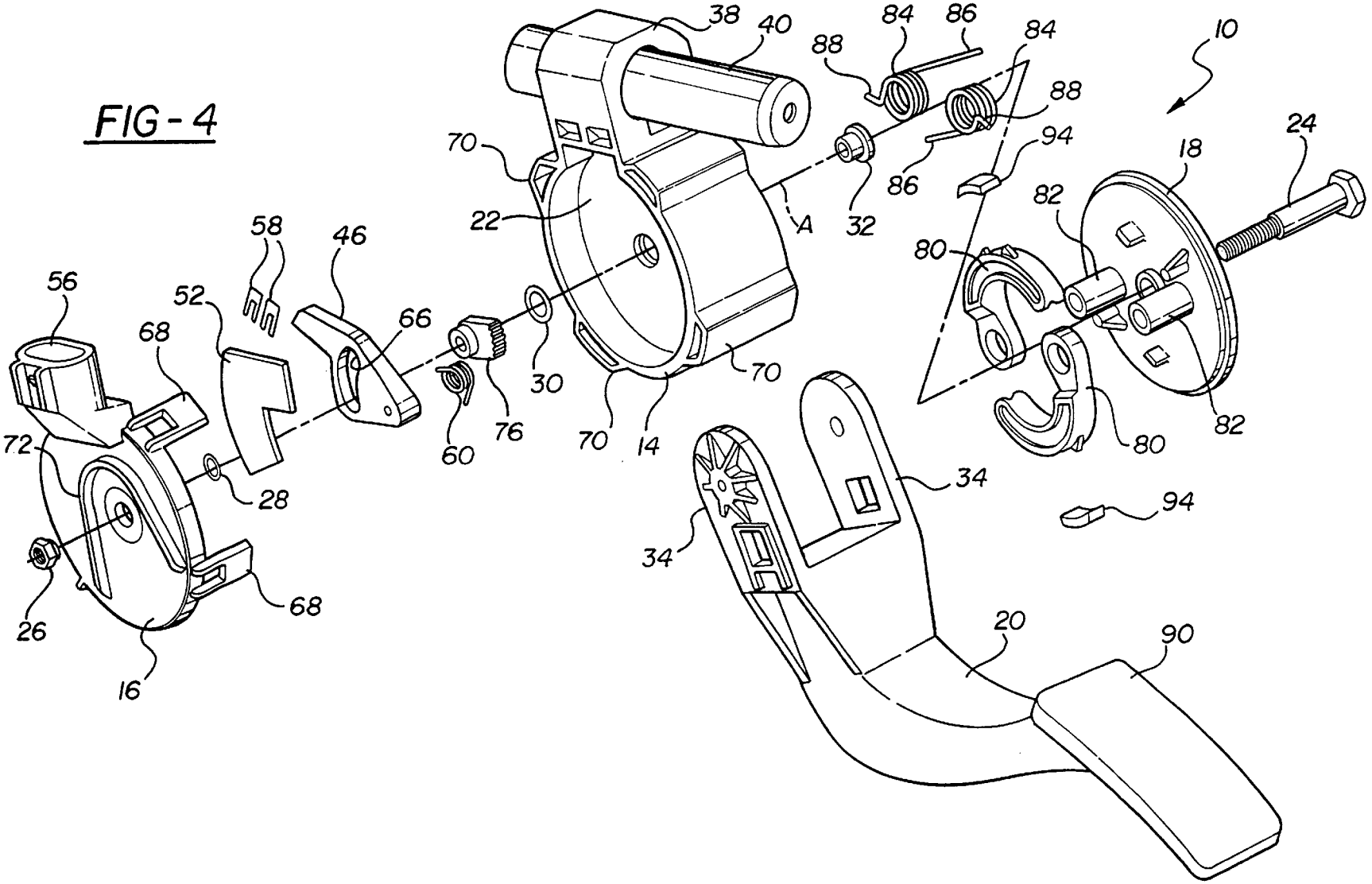
FIG. 4 is an exploded-perspective view from the sensor cover side of the preferred embodiment.
Figure 5:
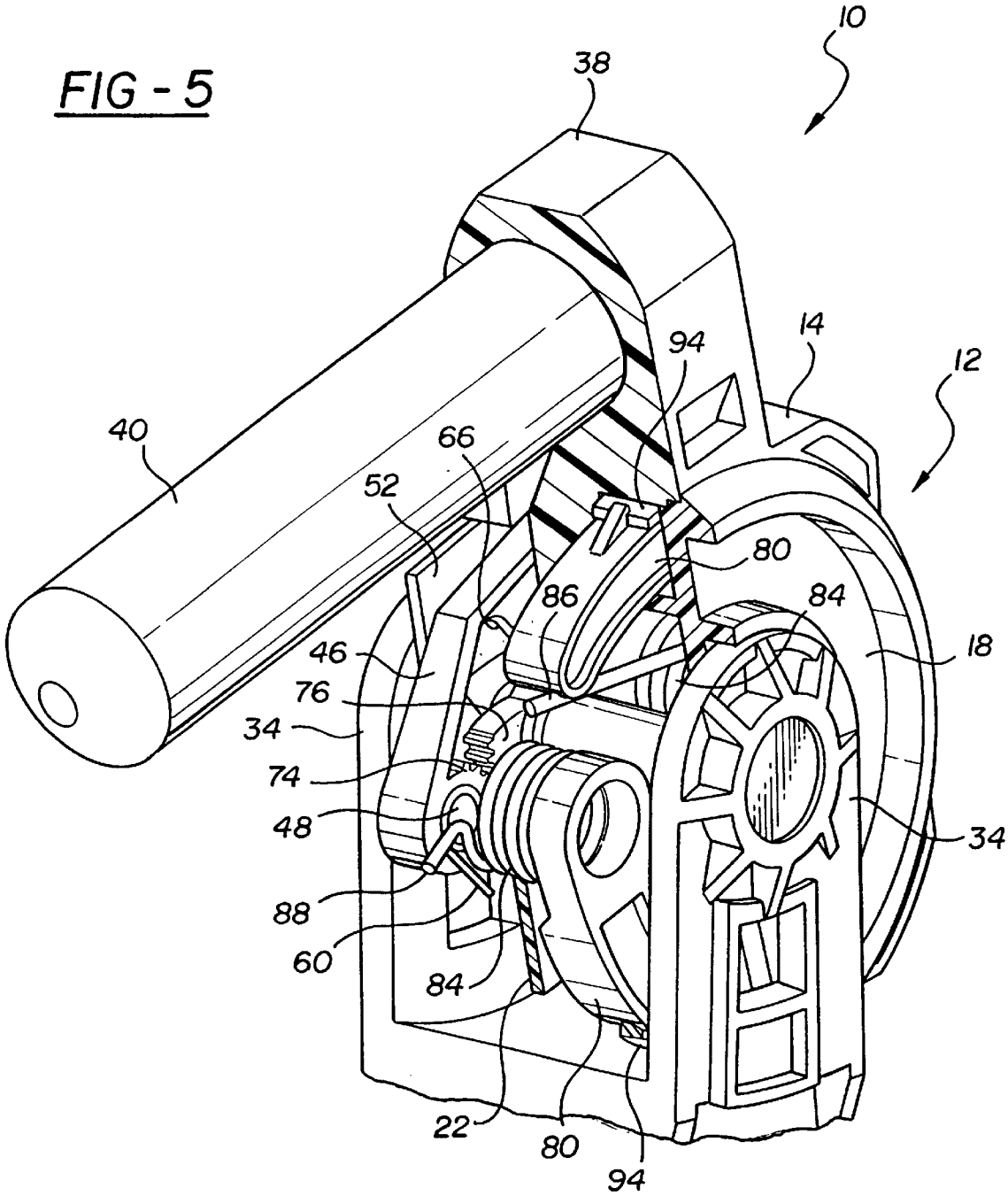
Figure 6:
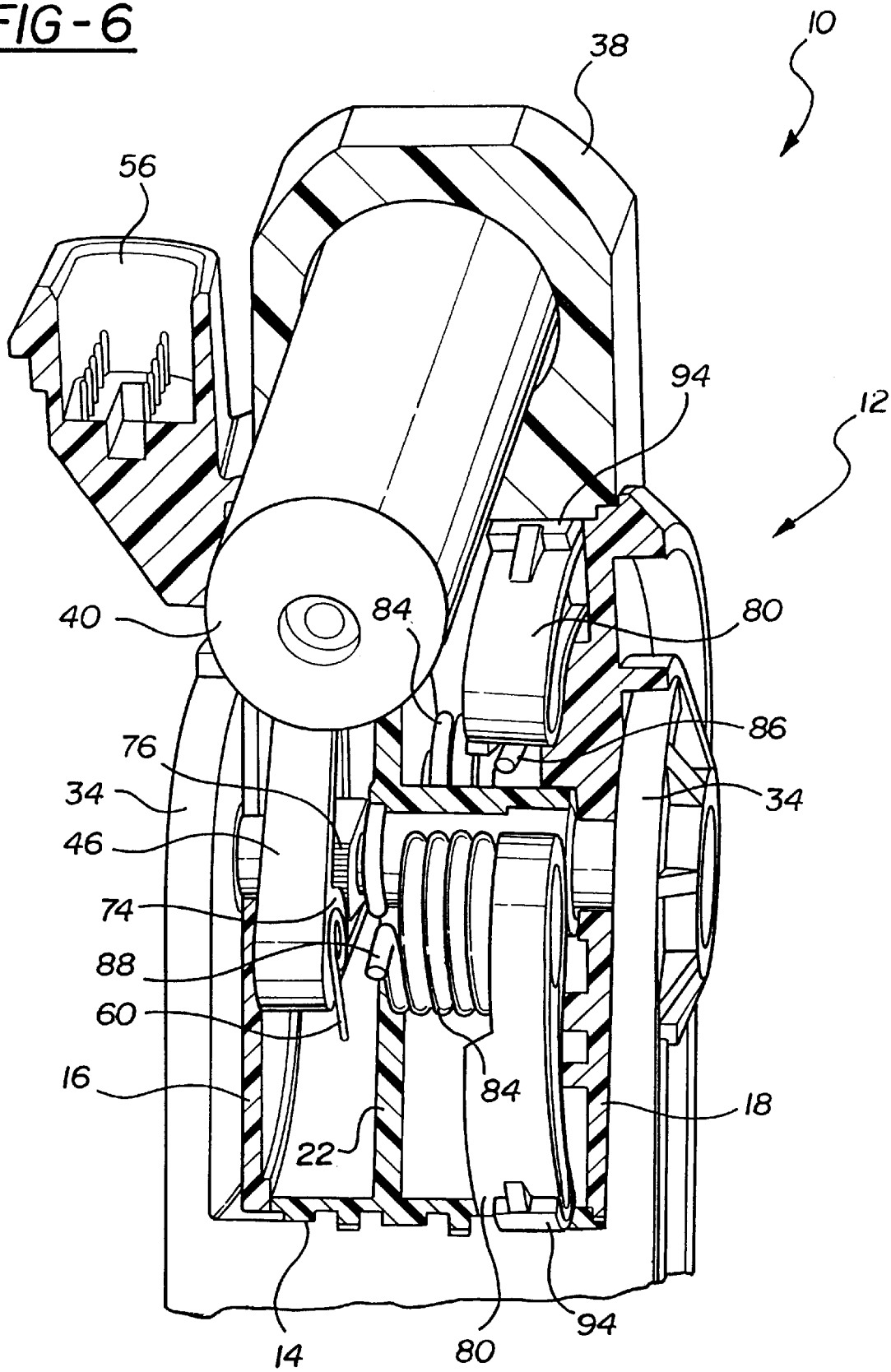
FIG. 6 is a perspective view from the front and partially cut away and in cross section of the preferred embodiment.

Referring to the Figures, wherein like numerals indicate like or corresponding parts throughout the several views, a pedal assembly for electronically controlling a vehicle is generally shown at 10.

The assembly 10 includes a housing, generally shown at 12, having opposite sides. The housing 12 includes a central drum section 14 extending between open first and second ends. A sensor cover 16 closes the first end to define one of the housing sides and a brake cover 18 closes the second end to define the other housing side.

A pedal lever 20 is supported by the housing 12 for pivotal movement about a pedal axis (A) extending between the sides, i.e., between the covers 16 and 18.

The central section 14 of the housing 12 includes a center partition 22 and a shaft 24 extends through the covers 16 and 18 and the partition 22. The shaft 24 comprises a bolt and nut 26 that also support the o-ring seals 28 and 30 and the bushing 32. Alternatively, the shaft may be a press fit pin with snap-in bushings replacing the nut 26 and bushing 32. The pedal lever 20 has a forked end with two tongs 34 and the covers 16 and 18 of the housing 12 are disposed between the tongs 34 with the tongs 34 secured to the shaft 24 and the brake cover 18 for rotation therewith. The brake cover 18 includes a rib 36 to define a stop or mechanical connection engaging one tong of the pedal lever 20 so that the brake cover 18 rotates relative to the central section 14 of the remainder of the housing 12.

The central section 14 of the housing 12 includes a carrier section 38 slidably supported on a guide rod 40 for adjusting the operative positions of the pedal assembly 10 for accommodating vehicle operators having different leg lengths. The rod 40 is supported by a bracket 42 adapted to be mounted on a vehicle structure and the guide section 38 is moved rectilinearly along the guide rod 40 between various adjusted positions by a screw 44, as is well known in the art and exemplified by the disclosure in U.S. Pat. No. 5,964,125.

The sensor cover 16 of the housing 12 movably supports a sensor arm 46. More specifically, the sensor arm 46 is pivotally supported by the sensor cover 16 for pivotal movement about a sensor axis defined by a pin 48 extending integrally from the sensor cover 16. The sensor axis of the pin 48 is spaced from the pedal axis (A) and disposed on one diametrical side of the pedal axis (A) with the sensor arm 46 extending to the opposite diametrical side of the pedal axis (A).

A plurality of the sensing bands 50 are supported on the sensor cover 16 of the housing 12 via a plate 52 and the bands 50 disposed arcuately (circular segments) at different radial distances from the sensor axis of the pin 48. The sensor bands 50 are in electrical contact with electrical pins 54 which are in electrical communication with the electrical connector 56 that connects to the vehicle system. A plurality of sensor members 58 are supported on the sensor arm 46 at the different radial distances form the sensor axis 48 and each of the sensor members 58 is paired with one of the sensor bands 50.

A coil spring defines a biasing device 60 for applying a biasing force to the sensor arm 46 for urging the sensor arm 46 to rotate about the sensor axis of the pin 48. The spring 60 reacts between the sensor arm 46 and an abutment pin 62 extending from the sensor cover 16. Also included is a stop 64 to limit rotary movement of the sensor arm 46 about the sensor axis 48 in response to the biasing force applied by the biasing device 60. In order to accommodate movement of the sensor arm 46 and the sensor member 58 radially through the pedal axis (A), the sensor arm 46 includes an opening 66 and the pedal axis (A) is disposed in the opening 66. Accordingly, the sensor bands 50 and the sensor members 58 are disposed on the opposite diametrical side of the pedal axis (A) from the sensor axis.48.

The sensor cover 16 is prevented from rotating relative to the central section 14 of the housing 12 by tabs 68 that snap into pockets 70 in the central section 14. In addition, the sensor cover 16 includes an external ridge 72 that accommodates pivotal movement of the pedal lever 20 relative to the sensor cover 16.

The assembly is characterized by a mechanism of at least two elements movable relative to one another and interconnecting the pedal lever 20 and the sensor arm 46 for moving the sensor arm 46 in response to movement of the pedal lever 20. More specifically, one of the elements comprises a gear sector or sensor gear 74 and the other element comprises a pedal gear 76 rotatable by the pedal lever 20 through the shaft 24 about the pedal axis (A). The sensor gear 74 is disposed in the opening 66 of the sensor arm 46 and is in meshing engagement with the pedal gear 76 whereby the sensor gear 74 is rotatable by the pedal gear 76 for rotating the sensor arm 46 about the sensor axis 48. As alluded to above, the pedal axis (A) is disposed in the opening 66 in the sensor arm 46 to accommodate movement of the sensor arm 46 and the sensor member 58 radially through the pedal axis (A), i.e., the sensor members 58 are on a radial extending from the sensor axis 48 and which moves in an arc back and forth to either side of the pedal axis (A). In accordance with the invention, the pedal gear may drive a rack rectilinearly instead of in an arc. In any case, by employing two or more elements interconnecting the pedal lever 20 and the sensor arm 46, whether it moves in an arc or linearly, the requisite degree of movement of the sensor members 58 may be attained while minimizing the distance occupied between the pedal axis (A) and the sensor bands 50.

The assembly 10 also includes a braking mechanism supported by the brake cover 18 for providing resistance to movement of the pedal lever 20 about the pedal axis (A).

The assembly is also characterized by the sensor arm 46 and the braking mechanism being axially spaced from one another along the pedal axis (A) and disposed in radially overlapping relationship to one another. Such a combination also provides a compact pedal assembly 10.

The central section 14 of the housing 12 includes a inner cylindrical surface 78 a pair of brake shoes 80 are movably supported by the brake cover 18 of the housing 12 for movement radially outwardly into engagement with the cylindrical surface 78 for providing resistance to movement of the pedal lever 20. A pair of posts 82 extend axially from the inside of the brake cover 18 of the housing 12 and each of the brake shoes 80 extends arcuately from a pivot end pivotally supported by one of the posts 82 to a distal end. A brake actuator comprising a biasing coil spring 84 interconnecting each brake shoe 80 and the housing 12 for moving the brake shoe 80 into engagement with the inner cylindrical surface 78 in response to pivotal movement of the pedal lever 20 in a first direction, that is, as force is applied to the pedal pad 90 supported on the lower end of the pedal lever 20. Each coil spring 84 has a central coil disposed about one of the posts 82 with a first end 86 extending from the coil and engaging the distal end of the adjacent brake shoe 80 supported by that same post 82 and a second end 88 extending from the coil and engaging a shoulder 92 extending from the inner cylindrical surface 78 of the central section 14 of the housing 12. Each of the brake shoes 80 includes a brake pad 94 for frictional engaging the inner cylindrical surface 78.

As alluded to above, the brake cover 18 is rotatable with the pedal lever 20 relative to the central section 14 of the housing 12 as it rotates in response to an operator force applied to the pedal pad 90, the shaft 24 rotates to rotate the pedal gear 76. The pedal gear 76 rotates the sensor gear 74 to, in turn, rotate or pivot the sensor arm 46 about the sensor axis 48. As the sensor arm 46 moves in an arc, the sensor members 58 move along the sensor bands 50 to generate an electrical signal that is transmitted to the vehicle control system. At the same time or simultaneously, because of the mechanical driving connection provided by the rib 36 co-acting with one tong 34 of the pedal lever 20, the brake cover 18 rotates with the pedal lever 20 to uncoil the coil springs 84 as they react with the shoulders 92 of the central section 14 of the housing 12. The uncoiling action of the springs 84 cause the brake shoes 80 to pivot radially outward about the respective posts 82 so that the brake pads 94 frictionally engage the interior surface 78 of the central section 14 to thereby provide a resistance or hysteresis to movement of the pedal lever 20.

Obviously, many modifications and variations of the present invention are possible in light of the above teachings. For example, it is clear that the feature of utilizing at least two elements in a mechanism to interconnect the sensor arm and the pedal arm to reduce space while maintaining the requisite movement of the sensor members over the sensor bands may be used independently of the feature of spacing the braking mechanism axially from the sensor arm along the pedal axis (A) and disposed in radially overlapping relationship to one another. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

| Glossary of terms by reference numeral | | |
|---|---|---|
| pedal assembly 10 | rod 40 | tabs 68 |
| housing 12 | bracket 42 | pockets 70 |
| central section 14 | screw 44 | ridge 72 |
| sensor cover 16 | sensor arm 46 | sensor gear 74 |
| brake cover 18 | pin 48 | pedal gear 76 |
| pedal lever 20 | sensing bands 50 | cylindrical surface 78 |
| partition 22 | plate 52 | brake shoes 80 |
| shaft 24 | electrical pins 54 | posts 82 |
| nut 26 | electrical connector 56 | coiled springs 84 |
| o-ring seals 28 and 30 | sensor members 58 | first end 86 |
| bushing 32 | biasing device 60 | second end 88 |
| tongs 34 | abutment pin 62 | pedal pad 90 |
| rib 36 | stop 64 | shoulders 92 |
| carrier section 38 | opening 66 | brake pad 94 |

What is claimed is:

1. A pedal assembly for electronically controlling a vehicle comprising;

a housing (12), a pedal lever (20) supported by said housing (12) for pivotal movement about a pedal axis (A), a sensor arm (46) pivotally supported by said housing (12) for pivotal movement about a sensor axis spaced from and on one diametrical side of said pedal axis (A), at least one sensing band (50) supported by said housing (21) on the opposite side of said pedal axis (A), at least one sensor member (58) supported by said sensor arm (46) for movement with said sensor arm (46) to co-act with sensing band (50) on said opposite side of said pedal axis (A) from said sensor axis, said assembly characterized by a mechanism of at least two elements movable relative to one another and interconnecting said pedal lever (20) and said sensor arm (46) for moving said sensor arm (46) in response to movement of said pedal lever (20).

2. An assembly as set forth in claim 1 wherein at least one of said elements comprises a gear sector (74).

3. An assembly as set forth in claim 1 wherein said elements comprise meshing gears (74, 76) disposed between said pedal and sensor axes and said sensor arm (46) extends from said sensor axis back in the general direction of said pedal axis (A).

4. An assembly as set forth in claim 1 wherein said elements comprise a pedal gear (76) rotatable by said pedal lever (20) about said pedal axis (A) and a sensor gear (74) rotatable by said pedal gear (76) for rotating said sensor arm (46) about said sensor axis.

5. An assembly as set forth in claim 1 wherein said sensor arm (46) includes an opening (66) and said pedal axis (A) is disposed in said opening (66) to accommodate movement of said sensor arm (46) and said sensor member (58) radially through said pedal axis (A), said sensor gear (74) being disposed in said opening (66).

6. An assembly as set forth in claim 1 including a plurality of said sensing bands (50) disposed arcuately at different radial distances from said sensor axis and including a plurality of sensor members (58) on said sensor arm (46) at said different radial distances from said sensor axis, each of said sensor members (58) being paired with one of said sensor bands.

7. An assembly as set forth in claim 1 including a biasing device (60) applying a biasing force to said sensor arm (46) for urging sensor arm (46) to rotate about said sensor axis.

8. An assembly as set forth in claim 7, including a stop (64) to limit rotary movement of said sensor arm (46) about said sensor axis in response to said biasing force applied by said biasing device (60).

9. An assembly as set forth in claim 4 wherein said sensor arm includes an opening and said pedal axis is disposed in said opening to accommodate movement of said sensor arm and said sensor members through said pedal axis, said sensor gear being disposed in said opening.

10. An assembly as set forth in claim 9 including a plurality of said sensing bands disposed arcuately at different radial distances from said sensor axis and including a plurality of sensor members on said sensor arm at said different radial distances from said sensor axis, each of said sensor members being paired with one of said sensor bands.

11. An assembly as set forth in claim 10 including a biasing device applying a biasing force to said sensor arm for urging said sensor arm to rotate about said sensor axis.

12. An assembly as set forth in claim 11 including a stop to limit rotary movement of said sensor arm about said sensor axis in response to said biasing force applied by said biasing device.

* * * * *

UNITED STATES PATENT AND TRADEMARK OFFICE

CERTIFICATE OF CORRECTION

PATENT NO. : 6,725,741 B2
APPLICATION NO. : 09/974152
DATED : April 27, 2004
INVENTOR(S) : Brad C. Menzies It is certified that error appears in the above-identified patent and that said Letters Patent is hereby corrected as shown below:

In Column 6, line 22, Claim 7, please replace "urging sensor arm" with - -urging said sensor arm- -.

Signed and Sealed this

Twenty-second Day of August, 2006

JON W. DUDAS
*Director of the United States Patent and Trademark Office*